US008770340B2

(12) United States Patent
Cursetjee

(10) Patent No.: US 8,770,340 B2
(45) Date of Patent: Jul. 8, 2014

(54) SOUND-ABSORPTIVE PANEL FOR AN AIR HANDLING SYSTEM

(75) Inventor: Zareer Cursetjee, Happy Valley, OR (US)

(73) Assignee: Huntair, Inc., Tualatin, OR (US)

( * ) Notice: Subject to any disclaimer, the term of this patent is extended or adjusted under 35 U.S.C. 154(b) by 4 days.

(21) Appl. No.: 13/297,690

(22) Filed: Nov. 16, 2011

(65) Prior Publication Data

US 2013/0118830 A1 May 16, 2013

(51) Int. Cl.

| | |
|---|---|
| ***E04F 17/04*** | (2006.01) |
| ***E04B 1/82*** | (2006.01) |
| ***E04B 2/02*** | (2006.01) |
| ***E04B 9/00*** | (2006.01) |

(52) U.S. Cl.
USPC ..... 181/224; 181/284; 181/290

(58) Field of Classification Search
USPC ..... 181/224, 290, 284, 291, 294; 415/119; 428/172; 29/527.1
See application file for complete search history.

(56) References Cited

U.S. PATENT DOCUMENTS

| | | | | | |
|---|---|---|---|---|---|
| 3,412,513 | A | * | 11/1968 | Gosele | 52/144 |
| 4,276,954 | A | * | 7/1981 | Romano | 181/224 |
| 4,316,406 | A | * | 2/1982 | Lind | 454/284 |
| 4,317,503 | A | * | 3/1982 | Soderquist et al. | 181/290 |
| 4,347,912 | A | * | 9/1982 | Flocke et al. | 181/286 |
| 4,386,676 | A | * | 6/1983 | Gadde et al. | 181/290 |
| 4,432,434 | A | * | 2/1984 | Dean, Jr. | 181/225 |
| 4,513,548 | A | * | 4/1985 | Parker | 52/202 |
| 4,566,558 | A | * | 1/1986 | Link et al. | 181/210 |
| 4,747,505 | A | | 5/1988 | Hansen | |
| 4,749,390 | A | * | 6/1988 | Burnett et al. | 96/57 |
| 4,776,484 | A | * | 10/1988 | Hansen | 220/345.6 |
| 4,966,799 | A | * | 10/1990 | Lucca et al. | 428/95 |
| 5,009,043 | A | * | 4/1991 | Kurrasch | 52/145 |
| 5,135,073 | A | * | 8/1992 | Nelson | 181/290 |
| 5,245,141 | A | * | 9/1993 | Fortez et al. | 181/288 |
| 5,267,259 | A | * | 11/1993 | Gillhaus et al. | 373/143 |
| 5,300,178 | A | * | 4/1994 | Nelson et al. | 156/292 |
| 5,313,803 | A | * | 5/1994 | Detzer | 62/89 |
| 5,536,556 | A | * | 7/1996 | Juriga | 428/138 |
| 5,608,973 | A | * | 3/1997 | Karlstedt et al. | 34/60 |
| 5,712,447 | A | * | 1/1998 | Hanson | 114/20.1 |

(Continued)

FOREIGN PATENT DOCUMENTS

| | | |
|---|---|---|
| EP | 1 953 465 | 8/2008 |
| EP | 1 980 755 | 10/2008 |

(Continued)

OTHER PUBLICATIONS

Search Report and Written Opinion for counterpart application PCT/US2012/053852, mailed Feb. 20, 2013.

*Primary Examiner* — David Warren
*Assistant Examiner* — Christina Russell
(74) *Attorney, Agent, or Firm* — Schwegman Lundberg & Woessner, P.A.

(57) ABSTRACT

An assembly is configured to provide insulation and sound-dampening within an air-handling system. The assembly includes a single housing defining an internal chamber, at least one sound-absorption member within the internal chamber, wherein the at least one sound-absorption member is configured to dampen sounds generated by or within the air handling system, and an insulative material within the internal chamber, wherein the insulative material is configured to insulate the air handling system.

18 Claims, 6 Drawing Sheets

(56) References Cited

U.S. PATENT DOCUMENTS

| | | | | |
|---|---|---|---|---|
| 5,720,274 | A * | 2/1998 | Brunner et al. | 126/299 D |
| 5,961,702 | A * | 10/1999 | Doneit | 96/381 |
| 5,993,932 | A * | 11/1999 | Friedl et al. | 428/71 |
| 6,446,751 | B1 * | 9/2002 | Ahuja et al. | 181/295 |
| 6,554,059 | B2 * | 4/2003 | Hata et al. | 165/53 |
| 6,604,603 | B1 * | 8/2003 | Wirth | 181/200 |
| 7,048,500 | B2 * | 5/2006 | Cuvelier et al. | 415/119 |
| 7,066,532 | B2 * | 6/2006 | Schoemann | 296/193.07 |
| 7,246,681 | B2 * | 7/2007 | Christen | 181/285 |
| 7,597,534 | B2 * | 10/2009 | Hopkins | 415/119 |
| 8,079,898 | B1 * | 12/2011 | Stevenson | 454/328 |
| 8,087,494 | B2 * | 1/2012 | Palumbo et al. | 181/290 |
| 2002/0050418 | A1 * | 5/2002 | Jenvey | 181/224 |
| 2003/0066638 | A1 * | 4/2003 | Qu et al. | 165/186 |
| 2006/0272888 | A1 | 12/2006 | Lucas | |
| 2008/0128202 | A1 * | 6/2008 | Palumbo et al. | 181/292 |
| 2011/0014061 | A1 * | 1/2011 | Hopkins et al. | 417/3 |
| 2011/0189440 | A1 * | 8/2011 | Appleby et al. | 428/156 |
| 2011/0214935 | A1 * | 9/2011 | Cursetjee et al. | 181/224 |
| 2012/0036733 | A1 * | 2/2012 | Dehn | 34/282 |

FOREIGN PATENT DOCUMENTS

| | | |
|---|---|---|
| JP | 05-296485 | 11/1993 |
| JP | 2005-292183 | 10/1995 |
| JP | 2003-056861 | 2/2003 |
| KR | 20-1998-0022600 | 7/1998 |
| WO | WO-2013074186 A1 | 5/2013 |

* cited by examiner

SOUND-ABSORPTIVE PANEL FOR AN AIR HANDLING SYSTEM

BACKGROUND OF THE INVENTION

Embodiments relate generally to insulative and sound-absorptive panels configured for use with an air handling system.

Enclosed structures, such as occupied buildings, factories and animal barns, generally include an HVAC system for conditioning ventilated and/or recirculated air in the structure. The HVAC system includes a supply air flow path and a return and/or exhaust air flow path. The supply air flow path receives air, for example outside or ambient air, re-circulated air, or outside or ambient air mixed with re-circulated air, and channels and distributes the air into the enclosed structure. The air is conditioned by the HVAC system to provide a desired temperature and humidity of supply air discharged into the enclosed structure. The exhaust air flow path discharges air back to the environment outside the structure, or ambient air conditions outside the structure.

Air-handling systems (also referred to as air handlers) are used to condition buildings or rooms. An air-handling system is generally defined as a structure that includes components designed to work-together in order to condition air as part of a primary system for ventilation of structures. The air-handling system may contain components such as cooling coils, heating coils, filters, humidifiers, fans, sound attenuators, controls, and other devices that function to meet the desired conditions within a particular structure. The air-handling system may be manufactured in a factory and brought to the structure to be installed or it may be built on site.

An air-handling compartment of an air-handling system may include an inlet plenum upstream from a fan inlet cone and a discharge plenum. A fan unit may be secured within the air-handling compartment. Typically, the plenums and air conduits within an air-handling system are insulated to reduce the risk of fire and prevent moisture infiltration. Similarly, areas around the fan unit may also be insulated. Typically, the fan unit is within a housing having insulative panels that may be formed of an insulative foam.

As can be appreciated, a functioning air handling system also produces noise. For example, an operating fan unit may generate a substantial amount of noise. In order to muffle the sound of the noise generated by an air handling unit, separate and distinct sound-absorption panels are mounted onto the insulative panels. Typically, an insulative panel includes a metal frame into which the insulative foam is injected and housed. A sound-absorption panel typically includes a sound-absorption material encased by a perforated metal case. The sound-absorption material and perforated metal case are typically mounted directly onto a portion of the insulative panel. In this manner, the insulative panel provides an insulated path, while the separate and distinct sound-absorption panel absorbs undesirable sounds generated by or within the air handling unit by way of the perforated metal allowing sound waves to enter into, and be absorbed by, the sound-absorption panel.

However, the separate and distinct sound-absorption panel adds size and bulk to the panel assembly. Because the sound-absorption panel mounts onto the insulative panel, the air handling unit takes up additional space. Also, the process of mounting separate and distinct sound-absorption panels to the insulative panels is typically labor intensive and utilizes various separate and distinct fasteners, mounting structures, and the like.

SUMMARY OF THE INVENTION

Certain embodiments provide an assembly configured to provide insulation and sound-dampening within an air-handling system that is configured to condition air within an enclosed room of a building. The assembly includes a single housing defining an internal chamber, at least one sound-absorption member within the internal chamber, wherein the at least one sound-absorption member is configured to dampen sounds generated by or within the air handling system, and an insulative material within the internal chamber, wherein the insulative material is configured to insulate the air handling system.

The sound-absorption member(s) may include at least one sound-absorption insert. The sound absorption insert(s) may be retained within at least one tray within the internal chamber. Optionally, the sound-absorption insert(s) may be retained within a reciprocal channel or pocket formed in the insulative material. The sound-absorption member may be formed of fiberglass. The sound-absorption member(s) may include a plurality of aligned sound-absorption members. Alternatively, the sound-absorption member may be a single sound-absorption member that has an area equal to at least one surface of the single housing.

The insulative material may include a foam that is injected into the internal chamber. The foam maybe a polyurethane foam.

The single housing may include a frame connected to first and second plates. The internal chamber may be defined between the frame and the first and second plates. At least one of the first and second plates may include at least one sound passage section proximate the at least one sound-absorption member. The at least one sound passage section may include a plurality of sound passages that allow sound waves to pass therethrough and into the sound-absorption member. The sound passage section may include at least one perforated sheet secured to at least one of the first and second panels. Alternatively, the sound passage section(s) may be integrally formed into at least one of the first and second plates. The internal chamber may be contained within a volume defined by a width, height, and depth of the frame.

Certain embodiments provide a method of forming an assembly configured to provide insulation and sound-dampening within an air-handling system that is configured to condition air within an enclosed room of a building. The method may include forming an outer frame for the assembly, securing first and second plates to the outer frame so that an internal chamber is defined between the outer frame and the first and second plates, defining at least one sound-absorbing insert area within the internal chamber, injecting an insulative material into the internal chamber, allowing the insulative material to expand and set within the internal chamber, and securing at least one sound-absorbing insert into the at least one sound-absorbing area.

The method may also include covering the at least one sound-absorbing insert with at least one perforated sheet that secures to one or both of the first or second plates. One or both of the first or second plates may include at least one sound passage section formed therethrough. The at least one sound passage section may align with the at least one sound-absorbing insert.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
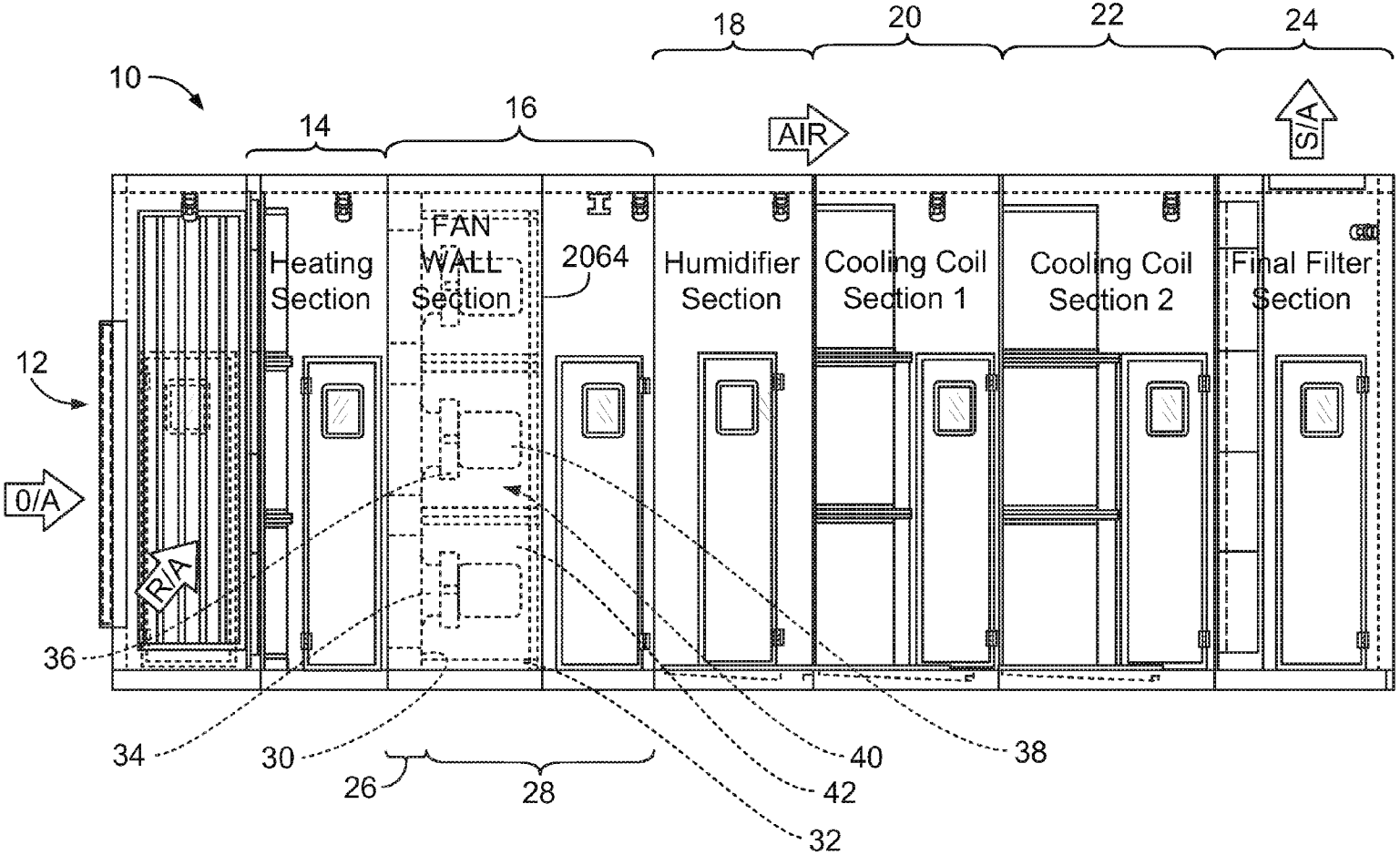
FIG. 1 illustrates a transverse interior view of an air processing system 10, according to an embodiment.

FIG. 1 illustrates a transverse interior view of an air processing system 10, according to an embodiment. The system 10 may be used with respect to an HVAC system used to condition air within a building. The system 10 is configured to condition air supplied to an enclosed room within a building and includes an inlet 12 that receives air. A heating section 14 that heats the air is included and followed by an air handling section 16. A humidifier section 18 may be located downstream of the air handling section 16. The humidifier section 18 is configured to add and/or remove moisture from the air. Cooling coil sections 20 and 22 may be located downstream of the humidifier section 18 to cool the air. A filter section 24 may be located downstream of the cooling coil section 22 to filter the air. The sections may be reordered or removed. Additional sections may be included.

The air handling section 16 includes an inlet plenum 26 and a discharge plenum 28 that are separated from one another by a bulkhead wall 30 that forms part of a frame 32. Fan inlet cones 34 are located proximate to the bulkhead wall 30 of the frame 32. The fan inlet cones 34 may be mounted to the bulkhead wall 30. Alternatively, the frame 32 may support the fan inlet cones 34 in a suspended location proximate to, or separated from, the bulkhead wall 30. Fans 36 are mounted to drive shafts on individual corresponding motors 38. The motors 38 are secured to mounting blocks of the frame 32. Each fan 36 and the corresponding motor 38 form one of the individual fan units 40 that may be held in separate chambers 42. The chambers 42 are shown vertically stacked upon one another in a column. Optionally, more or fewer chambers 42 may be provided in each column. One or more columns of chambers 42 may be provided adjacent one another in a single air handling section 16.

Figure 2:
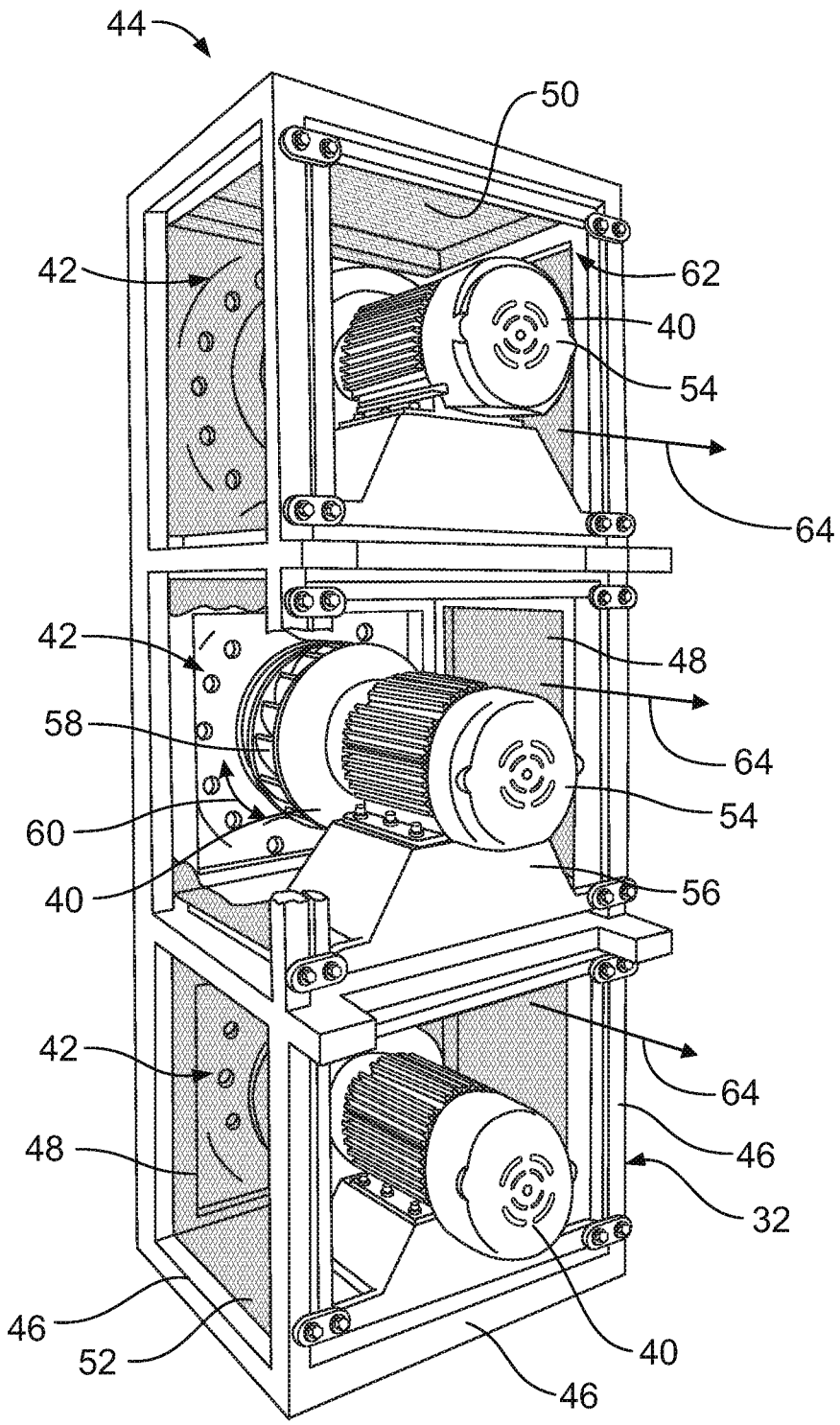
FIG. 2 illustrates a side perspective view of a column of chambers and corresponding fan units, according to an embodiment.

FIG. 2 illustrates a side perspective view of a column 44 of chambers 42 and corresponding fan units 40, according to an embodiment. The frame 32 includes edge beams 46 extending horizontally and vertically along the top, bottom and sides of each chamber 42. Side panels 48 are provided on opposite sides of at least a portion of the fan unit 40. Top and bottom panels 50 and 52 are provided above and below at least a portion of the fan units 40. The top and bottom panels 50 and 52 may be provided above and below each fan unit 40. Alternatively, panels 50 and 52 may be provided above only the uppermost fan unit 40, and/or only below the lowermost fan unit 40.

Motors 54 are mounted on brackets 56 that are secured to the edge beams 52. Fans 58 may be open sided plenum fans that draw air inward along the rotational axis of the fan and radially discharge the air about the rotational axis in the direction of arc 60. The air then flows from the discharge end 62 of each chamber 42 in the direction of arrows 64.

The side, top and bottom panels 50, 52, and 48 may be formed as integral insulating and sound-absorbing or attenuating panels, as explained below in connection with various embodiments. The air handling processing system 10 and fan units 40 are further described in U.S. Patent Application Publication No. 2011/0014061, entitled "Fan Array Control System," and U.S. Pat. No. 7,597,534, entitled "Fan Array Fan Section In Air-Handling Systems," both of which are hereby incorporated by reference in their entireties. Indeed, embodiments may be used with various air handling or processing systems.

Figure 3:
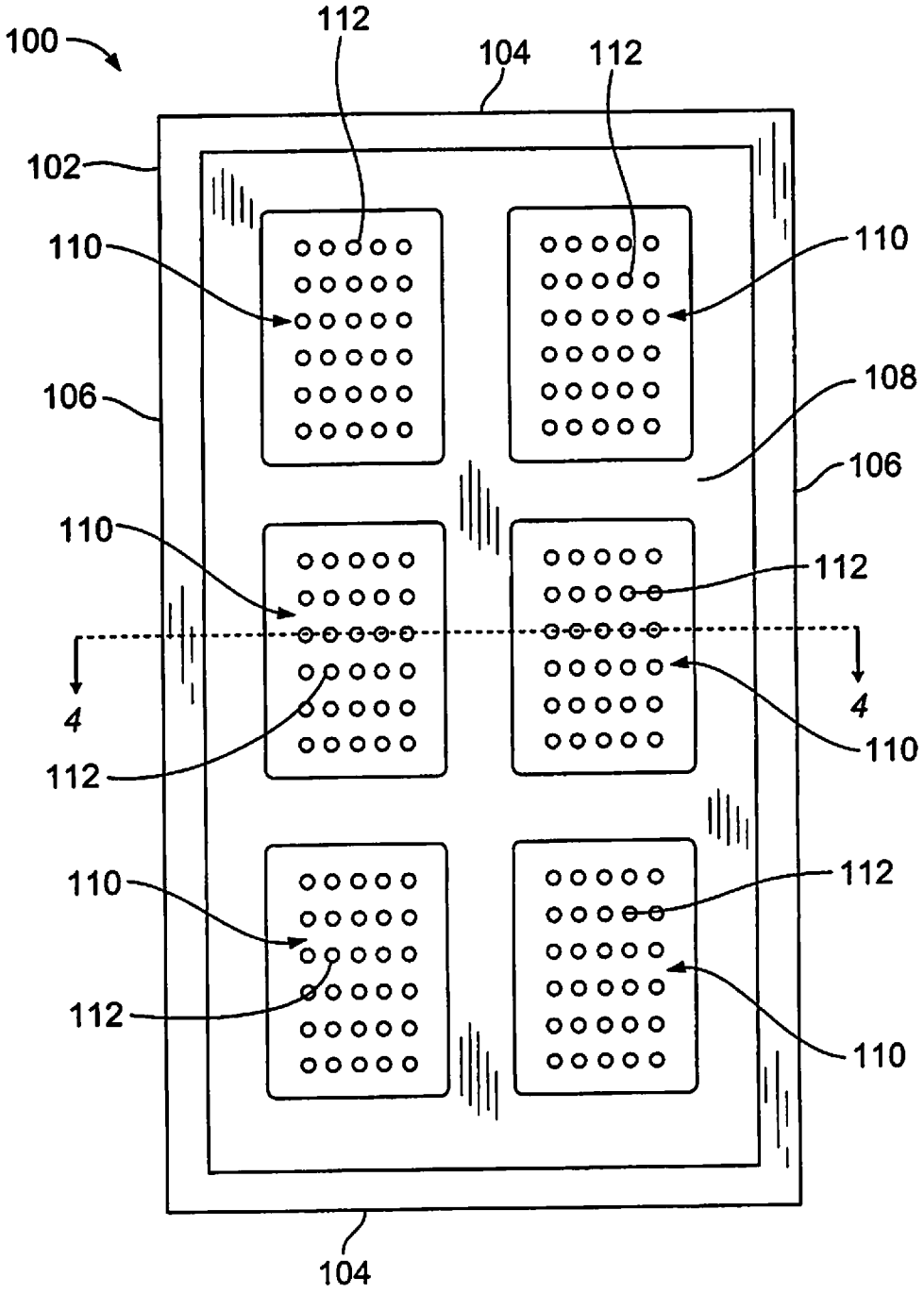
FIG. 3 illustrates a plan view of an air handling panel assembly, according to an embodiment.

FIG. 3 illustrates a plan view of an air handling panel assembly 100, according to an embodiment. The air handling panel assembly 100 may be used in place of any of the panels noted above, or, indeed, in place of any insulative panel within an air-handling or processing system.

The assembly 100 includes a frame 102 having parallel cross beams 104 integrally connected to parallel extension beams 106. As shown in FIG. 3, the frame 102 may be shaped as a rectangle. However, the frame 102 may be various other shapes and sizes, depending on the area into which the frame 102 is to be secured within an air-handling or processing system. The frame 102 may be formed of an extruded material, such as plastic, rubber, or the like. Optionally, the frame 102 may be formed of a metal, such as aluminum or stainless steel.

The frame 102 supports and retains a base plate (not shown) and an upper plate 108, each of which may be formed of metal, such as aluminum, stainless steel, or plastic, for example. The base and upper plates 108 define an internal chamber therebetween into which foam insulation is injected, as explained below. The upper plate 108 includes multiple sound-passage sections 110, each of which includes a plurality of sound passages 112, such as perforations, holes, channels, or the like, that allow sound waves to pass therethrough. As explained below, each of the sound-passage sections 110 covers a sound-absorbing insert contained within the assembly 100.

The upper plate 108 may include more or less sound-passage sections 110 than those shown. As shown in FIG. 3, the sound-passage sections 110 may correspond to fan units, for example, within an air handling system, such as the system 100. Each sound-passage section 110 may be positioned over an open area of a fan unit chamber. The solid portions of the upper plate 108 may abut support structures within a cabinet that houses the fan units, for example.

Additionally, while sound-passage sections 110 are shown in aligned columns and rows, the sound passage sections 110 may be located at various other positions on the upper plate 108. Also, the base plate, while not shown, may or may not include sound-passage sections that cover sound-absorbing inserts.

Figure 4:
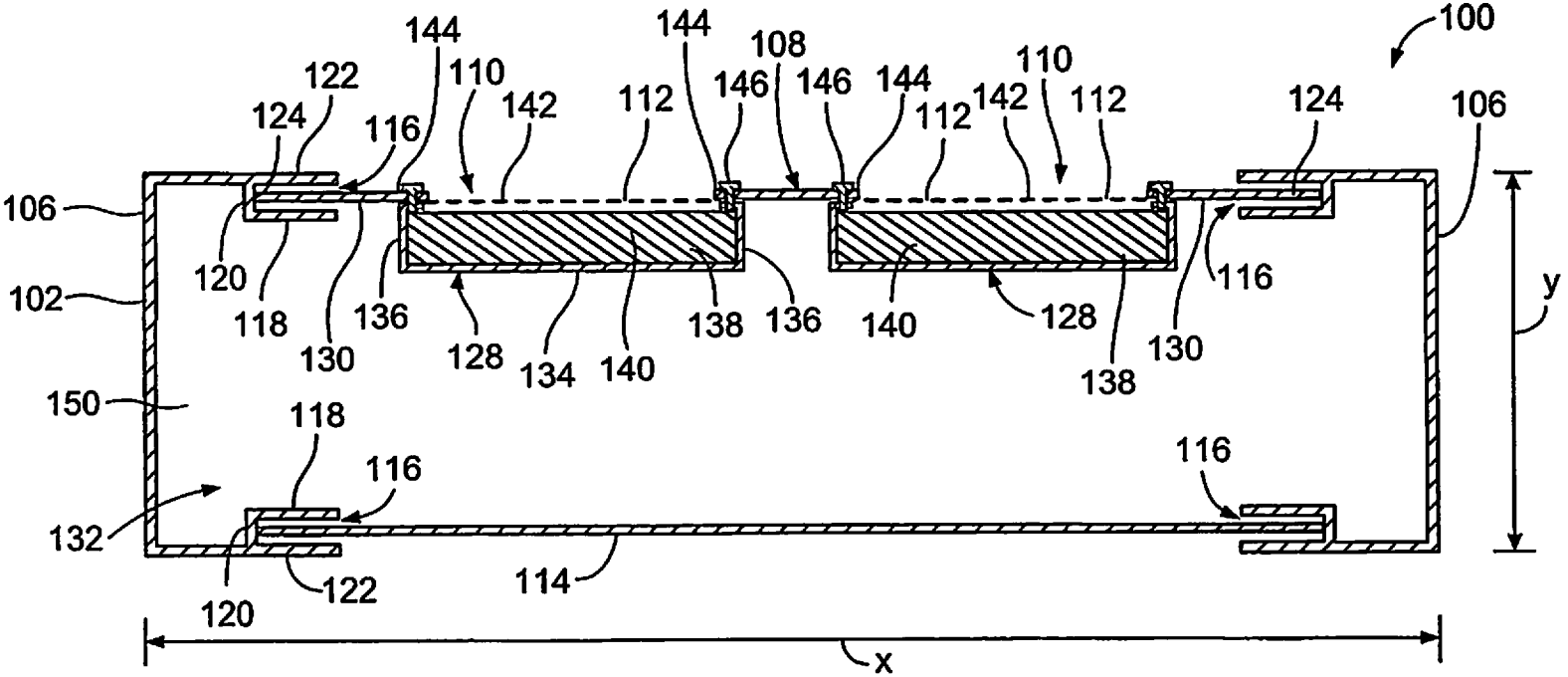
FIG. 4 illustrates a cross-sectional view of an air handling panel assembly through line 4-4 of FIG. 3, according to an embodiment.

FIG. 4 illustrates a cross-sectional view of the air handling panel assembly 100 through line 4-4 of FIG. 3, according to an embodiment. The assembly 100 includes the upper plate 108 secured to the extension beams 106, as well as the cross beams 104 (shown in FIG. 1). Similarly, a base plate 114 is secured to the extension beams 106 and the cross beams 104.

As shown in FIG. 4, each of the upper plate 108 and the base plate 114 may be a planar sheet of material, such as metal or plastic. The upper plate 108 secures within opposed channels 116 of the frame 102. The channels 116 are formed in the extension beams 106 and the cross beams 104. The channels 116 are defined by a ledge 118 integrally connected to a perpendicular wall 120, which, in turn, integrally connects to an over-hanging strap 122 that is parallel to the ledge 118. Outer edges 124 of the upper plate 108 are urged into the channels 116 and sandwiched by the over-handing strap 122 and the ledge 118. The outer edges 124 of the upper plate 108 may be securely retained within the channels 116 through an interference fit, for example. Optionally, the outer edges 124 of the upper plate 108 may be secured within the channels 116 through fasteners that pass through the strap 122, the outer edge 124, and the ledge 118. For example, the outer edges 124 may be secured within the channels 116 through nuts and bolts. Alternatively, the outer edges 124 may be bonded to the frame 102, or secured thereto through adhesives. Outer edges of the base plate 114 are secured to the frame 102 in a similar manner.

Optionally, the frame 102, the base plate 114, and the upper plate 108 may all be integrally formed together as a single piece. For example, the frame 102, the base plate 114, and the upper plate 108 may all be formed as a single, contiguous frame of metal or plastic.

Sound panel trays 128 connect from lower surfaces 130 of the upper plate 108 and into an internal chamber 132 defined by the frame 102, the upper plate 108, and the base plate 114. The sound panel trays 128 may be formed of a metal or plastic, for example. Each sound panel tray 128 includes a base 134 integrally formed with lateral walls 136 and end walls (not shown in FIG. 4) that extend perpendicularly from the base 134. The base 134, the lateral walls 136, and end walls (not shown in FIG. 4) define an insert chamber 138 into which a sound-absorbing insert 140 is received and retained.

The sound-absorbing insert 140 may be formed of any sound-absorbing or dampening material, such as fiberglass, rubber, or the like, for example. The sound-absorbing insert 140 is sized and shaped to securely conform to the insert chamber 138. The sound-absorbing insert 140 may be a layer of sound-absorbing material that is directly laid into the insert chamber 138. Optionally, the sound-absorbing insert 140 may be contained within a cartridge or frame that is placed within the insert chamber 138.

Each sound passage section 110 includes a sheet 142 having the passages 112 secured over the sound-absorbing inserts 140 within the insert chambers 138. As shown in FIG. 4, outer edges of the sheets 142 are secured between interior edge portions 144 of the upper plate 108 and ledge portions of the lateral walls 136 through fasteners 146. The passages 112 may be perforations punched through the sheet 142, which may be formed of metal. Optionally, the sheets 142 may be integrally formed with the upper plate 108 so that separate and distinct fasteners are unnecessary. As noted above, sound passage sections 110 may be formed in the base plate 114, as well.

Insulation foam 150 is injected into the internal chamber 132. The insulation foam 150 may be various kinds of foam that prevent moisture from passing therethrough and protect against fire. The insulation foam 150 may also diminish or prevent heat transfer therethrough. As an example, the insulation foam may be polyurethane foam or open-cell foam. The insulation foam 150 is injected into the internal chamber 132 and may expand to fill any and all internal crevices, recesses, or other openings within the internal chamber that are not blocked by solid walls, such as an insert tray, for example.

As shown in FIG. 4, the entirety of the assembly 100 may be contained within a volume defined by the frame 102. That is, in an embodiment, no portion of the assembly 100 extends past the width x, height y, or depth of the frame 102. Instead, the components of the assembly 100 are contained within a single housing having a regularly-sized panel shape. That is, protuberances, protrusions, additional housing features, and the like, do not extend from the panels 108 and 114.

Thus, the assembly 100 provides an integrated system that provides insulation, as well as sound-absorption qualities. The sound-absorbing inserts 140 are secured within the assembly 100. As such, when compared to known panels having one section stacked and mounted on another, the assembly 100 is smaller and less bulky.

In operation, the insulation foam 150 within the internal chamber 132 provides insulation. Sound waves enter the sound passage sections 110 through the passages 112 and pass into the sound-absorbing inserts 140, which absorb the sound waves. In this manner, the assembly 100 reduces the level of noise generated within an air handling or processing system while at the same time providing insulation within an efficient and smaller package as compared with known panels.

Figure 5:
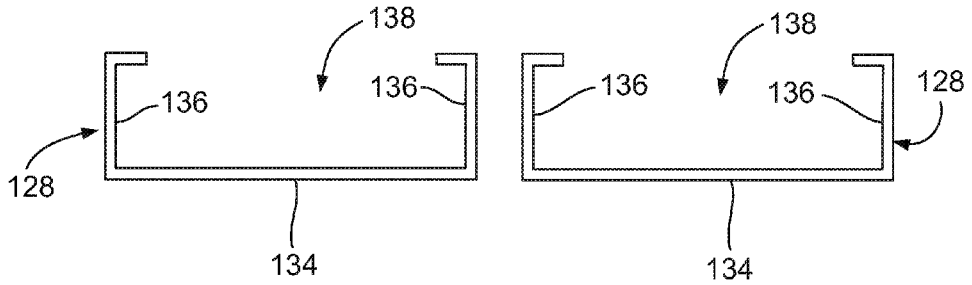
FIG. 5 illustrates a cross-sectional view of sound panel trays, according to an embodiment.

FIG. 5 illustrates a cross-sectional view of the sound panel trays 128, according to an embodiment. As shown in FIG. 5, embodiments may include separate and distinct sound panel trays 128, each of which is configured to receive and retain separate and distinct sound-absorbing insert 140 (shown in FIG. 4).

Figure 6:
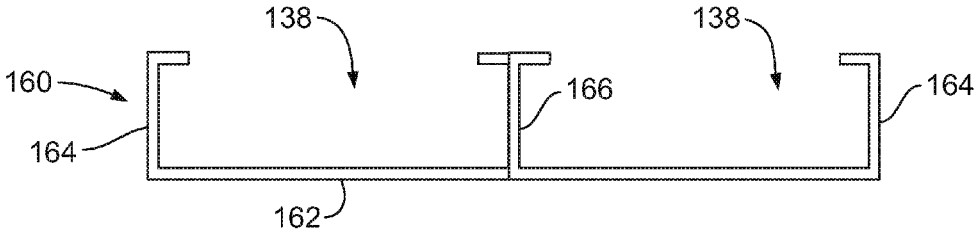
FIG. 6 illustrates a cross-sectional view of a sound panel tray according to an embodiment.

FIG. 6 illustrates a cross-sectional view of a sound panel tray 160, according to an embodiment. In this embodiment, the sound panel tray 160 includes a base 162 integrally formed with outer walls 164 (both lateral and end). A divider 166 extends from a mid-section of the base 162, thereby defining the separate insert chambers 138. Optionally, the divider 166 may not be included. Instead, a single large sound-absorbing insert may be positioned within the sound panel tray 160. Indeed, the sound panel tray 160 may be sized and shaped to conform to a desired area within the assembly 100. For example, the sound panel tray 160 may span over an area that corresponds to an entire outer surface area of the assembly 100, for example. Perforations may be formed above (and below) the corresponding sound-absorbing insert (s).

Also, alternatively, the assembly 100 may not include the trays 128 or 160. Instead, the sound-absorbing inserts 140 may be cradled within channels formed into the insulation foam 150.

Referring again to FIGS. 3 and 4, in order to form the assembly 100, the frame 102 is formed. As noted above, the frame 102 may be a single piece of extruded material, such as plastic. However, the cross beams 104 and the extension beams 106 may be separate and distinct components. In this case, the cross beams 104 are secured to the extension beams 106 through fasteners, bonding, adhesives, or the like.

After the frame 102 is formed, the upper plate 108 and the base plate 114 may be secured thereto, as explained above. The insert trays 128 or 160 may be secured to the upper plate 108 and/or the base plate 114 before or after the upper plate 108 and the base plate 114 are secured to the frame 102. Moreover, if no trays are being used, blocking plates or molds may be secured within the internal chamber 132 defined by the frame 102, the upper plate 108, and the base plate 114. The blocking plates or molds are used to define insert channels when the insulation foam is injected into the internal chamber 132.

Next, insulation foam is injected into the internal chamber 132 through an opening (not shown) formed through the frame 102, the base plate 114, or the upper plate 108. As the insulation foam 132 enters the internal chamber 132 and cools, the insulation foam expands to occupy the entirety of the internal chamber 132 (except for portions blocked by solid walls, such as, for example, insert trays), thereby forming the layer of insulation foam 150 shown in FIG. 4.

After the insulation foam 150 has set within the internal chamber, the sound-absorbing inserts 140 are positioned within the insert trays 128, for example. Next, the sheets 142 having perforations, for example, are secured over the sound-absorbing inserts 140.

Optionally, if the sheets 142 are integrally formed with upper plate 108 (or the base plate 114), the inserts 140 may be secured within the trays 128 and then the upper plate 108 is positioned over the trays 128. The upper plate 108 and the trays 128 retaining the inserts 140 are then secured to the frame 102, and the insulation foam may then be injected into the internal chamber 132.

Figure 7:
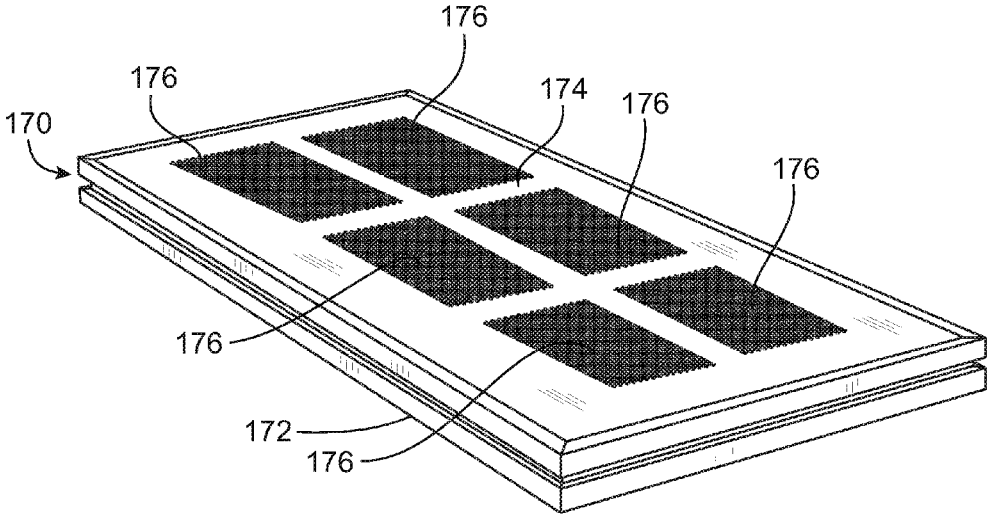
FIG. 7 illustrates an isometric top view of an air-handling panel assembly, according to an embodiment.

FIG. 7 illustrates an isometric top view of an air-handling panel assembly 170, according to an embodiment. The assembly 170 includes a frame 172 similar to the frame 102 described above. In general, the assembly 170 is similar to the assembly 100 described above, except that a plate 174 has a plurality of sound passage sections 176 integrally formed therein.

Figure 8:
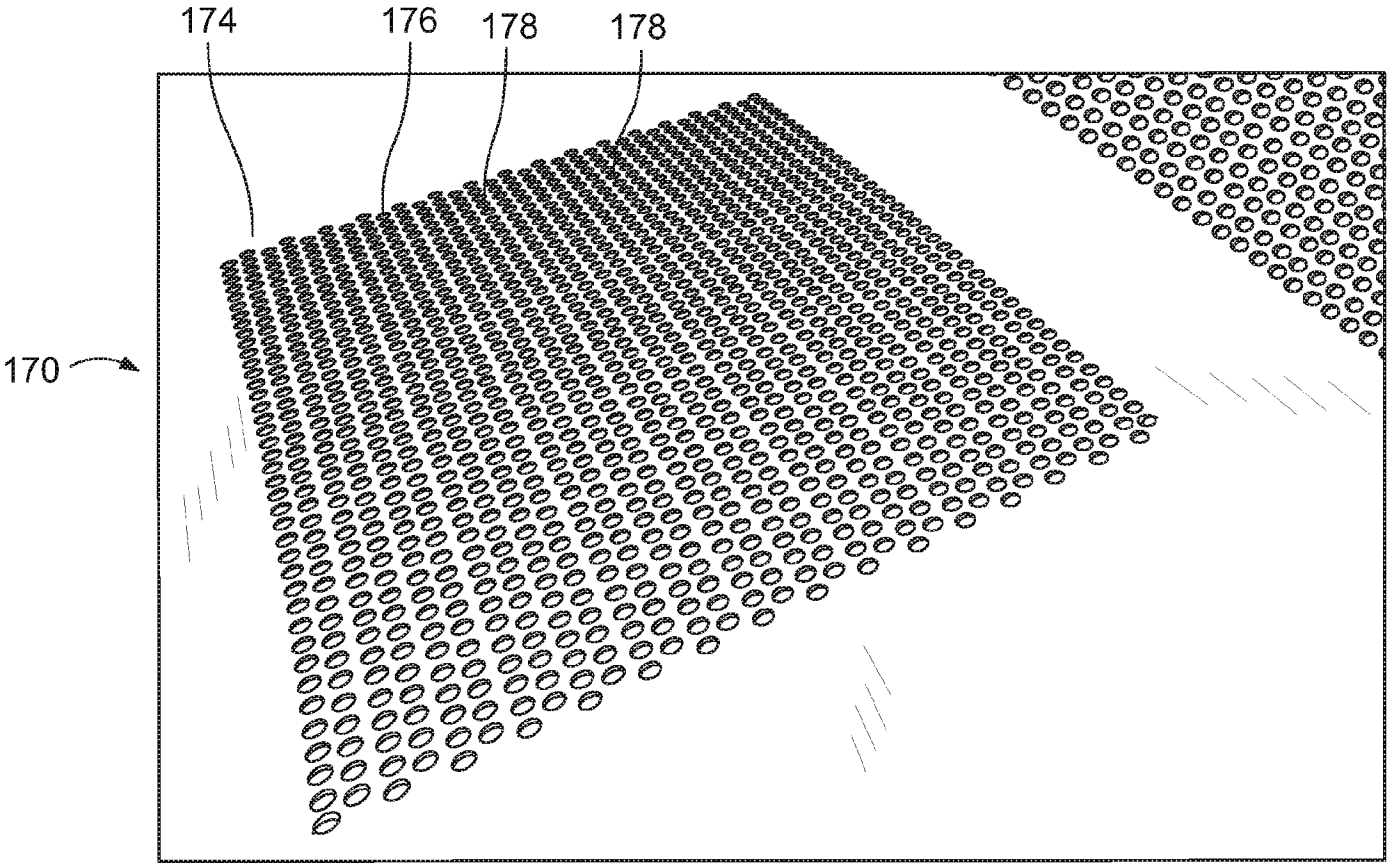
FIG. 8 illustrates an isometric top view of a sound passage section formed in an air-handling panel assembly, according to an embodiment.

FIG. 8 illustrates an isometric top view of a sound passage section 176 formed in the air-handling panel assembly 170, according to an embodiment. Referring to FIGS. 7 and 8, the sound passage sections 176 include a plurality of perforations 178 that are formed through the plate 174. The perforations 178 allow sound waves to pass therethrough and into a sound-absorbing insert (not shown in FIGS. 7 and 8) positioned underneath the perforations 178. The perforations 178 may be formed by way of a tool directly punching the perforations 178 into and through the plate 174. The integrally-formed sound passage sections 176 provide a unitary plate construction that does not use separate and distinct fasteners to secure the perforated sheets thereto. Accordingly, the assembly 170 may be more sturdy and reliable, and the process of manufacturing the assembly 170 may be streamlined.

Thus, embodiments provide an air-handling panel assembly having an insulative member and a sound-absorption member integrated into a single, compact housing. Both the insulative material and the sound-absorbing member(s) are entirely contained within a single housing having flat, planar plates connected to a frame. As shown in the Figures, the assembly may be configured such that no portion extends past the frame in any direction. That is, the assembly may be entirely contained within a volume defined by the dimensions of the frame, for example. As such, embodiments are more compact than known panels that include a sound-absorption layer mounted directly over an insulative housing. Further, embodiments provide a process of manufacturing an air-handling panel that is efficient and reliable.

While various spatial and directional terms, such as top, bottom, lower, mid, lateral, horizontal, vertical, front and the like may be used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An assembly configured to provide insulation and sound-dampening within an air-handling system configured to condition air within an enclosed room of a building, the assembly comprising:

a single housing defining an internal chamber;

at least one sound-absorption member including at least one sound-absorption insert within the internal chamber, wherein the at least one sound-absorption member is configured to dampen sounds generated by or within the air handling system; and an insulative material within the internal chamber, wherein the insulative material is configured to insulate the air handling system, wherein the at least one sound-absorption insert is retained within at least one tray within the internal chamber, wherein the at least one tray includes a base and outer walls, wherein the base and outer walls are distinct from the insulative material, and wherein the at least one tray is connected to the single housing.

2. The assembly of claim 1, wherein the at least one sound-absorption member and the insulative material are contained within a volume defined by a frame.

3. The assembly of claim 2, wherein no portion of the at least one sound-absorption member or the insulative material extends past a width, height, and depth of the frame.

4. The assembly of claim 1, wherein the at least one sound-absorption member is formed of fiberglass.

5. The assembly of claim 1, wherein the at least one sound-absorption member comprises a plurality of aligned sound-absorption members.

6. The assembly of claim 1, wherein the at least one sound-absorption Member comprises a single sound-absorption member that has an area equal to at least one surface of the single housing.

7. The assembly of claim 1, wherein the insulative material comprises a foam that is injected into the internal chamber.

8. The assembly of claim 7, wherein the foam comprises a polyurethane foam.

9. The assembly of claim 1, wherein the single housing comprises a frame connected to first and second plates, wherein the internal chamber is defined between the frame and the first and second plates.

10. The assembly of claim 9, wherein at least one of the first and second Plates comprises at least one sound passage section proximate the at least one sound-absorption member, wherein the at least one sound passage section comprises a plurality of sound passages that allow sound waves to pass therethrough and into the sound-absorption member.

11. The assembly of claim 10, wherein the at least one sound passage section comprises at least one perforated sheet secured to at least one of the first and second plates.

12. The assembly of claim 10, wherein the at least one sound passage section is integrally formed into at least one of the first and second plates.

13. A method of forming an assembly configured to provide insulation and sound-dampening within an air-handling system configured to condition air within an enclosed room of a building, the method comprising:

forming an outer frame for the assembly;

securing first and second plates to the outer frame so that an internal chamber is defined between the outer frame and the first and second plates;

defining at least one sound-absorbing insert area within the internal chamber;

injecting an insulative material into the internal chamber;

allowing the insulative material to expand and set within the internal chamber;

connecting at least one tray within the at least one sound-absorbing insert area and to at least one of the first and second plates housing, wherein the at least one tray is distinct from the insulative material; and securing at least one sound-absorbing insert into the at least one tray.

14. The method of claim 13, further comprising covering the at least one sound-absorbing insert with at least one perforated sheet that secures to one or both of the first or second plates.

15. The method of claim 13, wherein one or both of the first or second plates comprises at least one sound passage section formed therethrough, and wherein the at least one sound passage section aligns with the at least one sound-absorbing insert.

16. An assembly configured to provide insulation and sound-dampening within an air-handling system configured to condition air within an enclosed room of a building, the assembly comprising:

a single housing including a frame connected to first and second plates, wherein an internal chamber is defined between the frame and the first and second plates, wherein the internal chamber is contained within a volume defined by a width, height, and depth of the frame, wherein at least one of the first and second plates includes at least one sound passage section having a plurality of sound passages;

at least one sound-absorption fiberglass insert secured within the internal chamber, wherein the at least one sound-absorption fiberglass insert is proximate the at least one sound passage section, wherein the plurality of sound passages allow sound waves to pass into the sound-absorption fiberglass insert, wherein the at least one sound-absorption fiberglass insert is configured to dampen sounds generated by or within the air handling system; and an insulative polyurethane foam within the internal chamber, wherein the insulative polyurethane foam is configured to insulate the air handling system, wherein the tray includes a base and outer walls, wherein the base and outer walls are distinct from the insulative polyurethane foam, and wherein the tray is connected to the single housing.

17. The assembly of claim 16, wherein the at least one sound passage section comprises at least one perforated sheet secured to at least one of the first and second plates.

18. The assembly of claim 16, wherein the at least one sound passage section is integrally formed into at least one of the first and second plates.

* * * * *

UNITED STATES PATENT AND TRADEMARK OFFICE

CERTIFICATE OF CORRECTION

PATENT NO. : 8,770,340 B2
APPLICATION NO. : 13/297690
DATED : July 8, 2014
INVENTOR(S) : Cursetjee It is certified that error appears in the above-identified patent and that said Letters Patent is hereby corrected as shown below:

In the Claims

Column 9, line 13, Claim 6, delete “Member” and insert --member--, therefor

Column 9, line 25, Claim 10, delete “Plates” and insert --plates--, therefor

Column 10, line 26, Claim 16, after “secured”, insert --within a tray--, therefor Signed and Sealed this
Ninth Day of December, 2014

Michelle K. Lee

Michelle K. Lee
*Deputy Director of the United States Patent and Trademark Office*